United States Patent [19]

Carlson

[11] 4,133,271

[45] Jan. 9, 1979

[54] FOLDING TABLE WITH LOCKING HINGE

[75] Inventor: Casey L. Carlson, Minneapolis, Minn.

[73] Assignee: Sico Incorporated, Minneapolis, Minn.

[21] Appl. No.: 824,704

[22] Filed: Aug. 15, 1977

[51] Int. Cl.[2] ..... A47B 3/00

[52] U.S. Cl. ..... 108/113

[58] Field of Search ..... 108/113, 35; 297/159; 5/57 R

[56] References Cited

U.S. PATENT DOCUMENTS

| | | | |
|---|---|---|---|
| 653,762 | 7/1900 | Windom | 108/35 X |
| 1,622,462 | 3/1927 | Mc Manus | 5/57 R |
| 2,596,250 | 5/1952 | Klingler | 108/113 X |
| 3,075,809 | 1/1963 | Wilson | 297/159 |
| 3,861,325 | 1/1975 | Buc et al. | 108/113 |
| 4,027,600 | 6/1977 | Mueller | 108/113 |

*Primary Examiner*—Francis K. Zugel

*Attorney, Agent, or Firm*—Merchant, Gould, Smith, Edell, Welter & Schmidt

[57] ABSTRACT

An improved lockable hinge for a folding table of the type having table surface members which fold to a vertical storage position and to a horizontal usable position. The table is locked at an intermediate position when moving towards the usable position from the storage position by a pivoting lock bar which swings by gravity into a recess formed in a hinge plate on one half of the table and is jammed between the recess and a tab formed in the mating hinge plate on the other half of the table. A handle provided for the locking bar is bent away from the adjacent edges of the two table surface members and can be pivoted to withdraw the bar from the recess and around the tab as the table moves to the usable position. Release of the handle allows the locking bar to fall back into the recess engaging the other side of the tab to lock the table in the down position. A preferred embodiment allows the same hinge plate design to be used in both table halves.

8 Claims, 9 Drawing Figures

FOLDING TABLE WITH LOCKING HINGE

BACKGROUND OF THE INVENTION

The present invention pertains to improvements in folding tables, and more particularly in an improved lockable hinge for folding tables.

Folding tables are widely used in rooms that must be used for multiple purposes. The tables can be rapidly folded and put in storage, or set up in the room as may be required by circumstances. One popular type of prior art folding table comprises a pair of table surface members and means for hingeably interconnecting them along adjacent edges thereof. Leg assemblies are pivotally connected to the undersides of each of the table surface members, and cross connect links pivotally interconnect from the legs of one table surface member to the underside of the opposite table surface member. With this configuration, the table is foldable between a vertical storage position in which the table surface members and legs are generally vertically oriented for supporting the table in its folded position, and a horizontal usable position in which the table surface members are generally horizontally positioned and abutting along adjacent edges to define a table surface.

Locks have been provided for securing the table in its usable position so as to prevent inadvertent partial folding in case of excessive loads being applied to the outer edges of the table. One type of lock used on a table of this type in the prior art by the assignee of the present invention uses a pivoting locking bar positioned generally beneath the adjacent edges of the table and above and parallel to the hinge axis of the table. When unfolding the table, the bar falls by gravity action into notches provided in the hinge plates to lock the table in its down position. To fold the table, it is necessary to reach under the table to actuate a lever, rod or the like to release the latch.

It has recently been proposed to provide an additional locking function to stop folding tables just short of the horizontal usable position, when moving from the storage position. The purpose of such an intermediate locking function is to prevent the possibility of the operator accidentally getting his hand caught and pinched between adjacent edges of the table surface members as they come together towards abutment in the horizontal position. Often, depending upon the design of the table, the weight of the table tends to accelerate the unfolding operation as the table approaches the usable position, and an intermediate position lock will prevent the table from slamming abruptly to the open position.

It is not feasible to add an intermediate locking position to the prior art lockable hinge described in the second paragraph preceding by providing an additional set of notches for the locking bar, because of the position of the locking bar directly above the hinge axis between the adjacent edges of the table halves. Although this positioning of the locking bar works very well in the prior art locking hinge which has a lock only for the usable position of the table, it would be unacceptable in a device having an intermediate position lock because of the possibility that someone might try to place their hand between the adjacent edges of the table halves to release the locking bar.

One type of intermediate latch mechanism that has been proposed in the prior art involves the use of a separate spring operated latch and striker plate assembly near the center of the table. In this type of prior art device, the latch and striker plate operate completely independently of the hinges. A control rod runs from the latch to the side of the table to allow actuation thereof. The fact that the mechanism is independent of the hinges and is spring activated increases the number of parts and increases the cost of the table. In addition, the increased number of parts brings about an increased possibility that a part may be defective.

Another type of locking mechanism proposed in the prior art involves a rod which is mounted adjacent and parallel to the hinge axis between the adjacent edges of the table surface members. Ends or prongs of the rod pass through holes in hinge plates for one half of the table, to engage the edges of matting hinge plates for the other half of the table to form the intermediate lock, and to engage additional holes provided in the matting hinge plate to provide the lock for the usable position. The rod is held in the locked position by a spring, and is released by axially pulling the rod out of interference with the other hinge plate. Unfortunately this type of lock has the disadvantage of requiring a spring to engage the latch. Also, because of the necessary positioning of the rod between and beneath the adjacent edges, there is a chance that an operator might place a portion of his hand or thumb between the adjacent edges while releasing the latch to go from the intermediate to the full open positions of the table.

SUMMARY OF THE INVENTION

The present invention overcomes these and other problems by providing an improved lockable hinge for folding tables which is reliable in operation and simple in construction, which leads to lower costs of manufacture and lower cost to the ultimate user. The improved locking hinge of the present invention is for use on a folding table of the type having first and second table surface members, and legs pivotally attached thereto. The hinge assembly is provided for connecting the first and second table surface member along adjacent edges thereof to permit folding of the table between a storage position in which the table surface members are generally vertically oriented, and a usable position in which the table surface members are generally horizontally positioned adjacent each other to define a table surface. The hinge means comprises at least a pair of hinge plates attached perpendicularly to the table surface members beneath their adjacent edges with a pivot pin or bolt therethrough to define the pivot axis. A locking bar is pivotally suspended generally beneath the edge of one of the table surface members for permitting movement of the bar toward and away from the hinge plate on the same table surface member, which has a recess formed in its edge for receiving the locking bar. The hinge plate attached to the other table surface member has a tab formed on its edge at a position so that a first edge of the tab contacts the locking bar in its recess when the table reaches its intermediate position just short of the horizontal position. A handle attached to the bar beneath the side edge of the table and projecting perpendicularly of the bar away from the adjacent edges and the hinge assembly is used to pivot the locking bar from the recess to allow the table to move to its usable position. Release of the handle allows the locking bar to return to the recess, and the recess and the second edge of the tab serve as a lock to prevent the table from being opened without reactiviation of the handle.

In a preferred embodiment, a plurality of hinge plates are used, and these are of the same design with a recess in one edge and a tab on the opposite edge, to permit interchangeable use of the hinge plates on either side of the hinge.

DESCRIPTION OF THE PREFERRED EMBODIMENT

Figure 1:
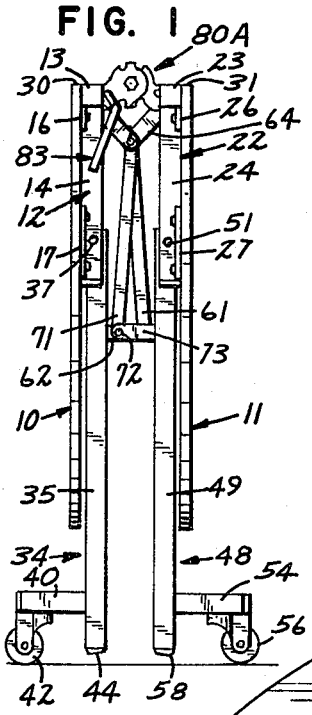
FIG. 1 is a side elevational view of a table according to the present invention shown in its storage position.
Figure 2:
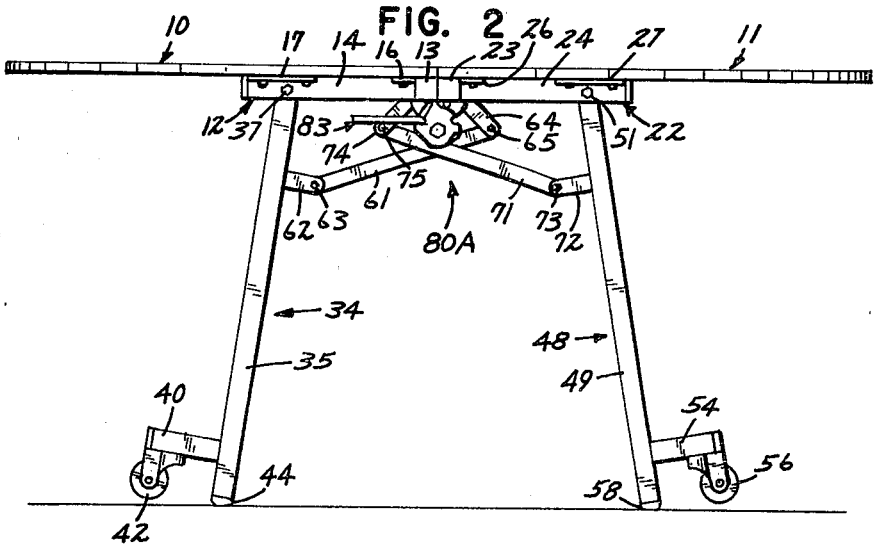
FIG. 2 is a side elevational view of the table of FIG. 1 shown in its usable position.
Figure 3:
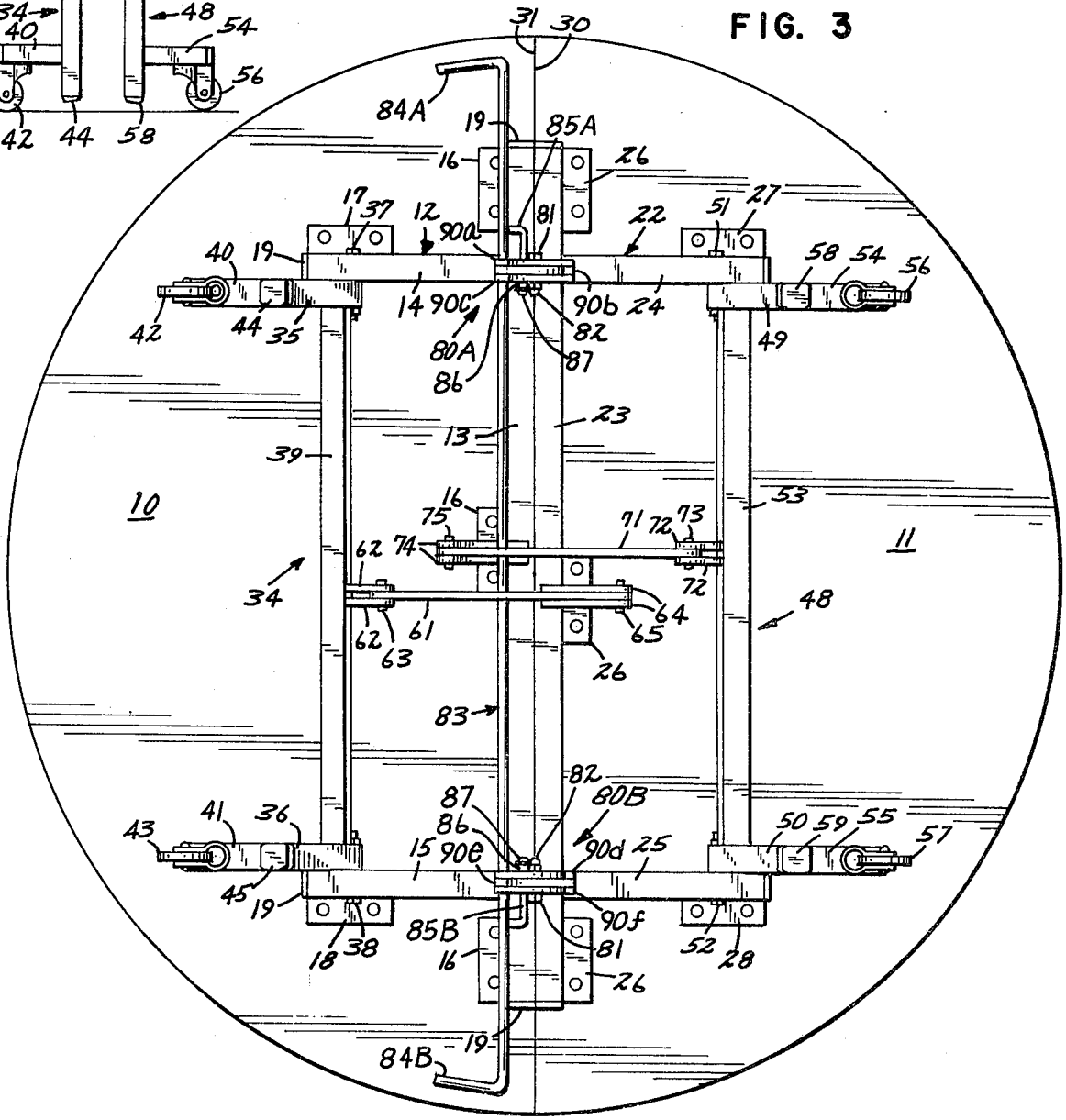
FIG. 3 is an enlarged bottom plan view of the table of FIG. 2.

As seen in FIGS. 1, 2 and 3, the folding table includes a pair of table surface members 10 and 11. In the embodiment shown, table surface members 10 and 11 are semicircular so as to form a round table, but it will be understood that the table could be rectangular, square or any other desired shape. The table surface members are preferably made of hardboard or particleboard, with a suitable decorative and durable top surface bonded thereto. The table surface members are secured to frames, and the frames are hinged together as explained hereinafter.

As best seen in FIG. 3, table surface member 10 is secured to a frame assembly 12. Frame assembly 12 comprises a main frame member 13 and a pair of frame arm members 14 and 15. Main frame member 13 and arms 14 and 15 may preferably be made of rectangular steel tubing, and the arms may be welded to the main frame member. Suitable end plugs 19 can be provided for the ends of the frame members. Main frame member 13 has tabs or plates 16 welded thereto which contain screw holes whereby the table surface member 10 can be secured to the frame. Arms 14 and 15 have similar tabs 17 and 18.

Table surface member 11 has a corresponding frame assembly 22, which comprises main frame member 23 and attached frame arm members 24 and 25. Tabs 26 are provided on main frame member 23, and similar tabs 27 and 28 are provided on arms 24 and 26 respectively for securing the table surface member. The frame members are seen also in FIG. 8.

Table surface members 10 and 11 have edges 30 and 31 respectively which abut each other when the table is in its usable position as shown in FIG. 2. These edges are referred to herein as the adjacent edges of the table surface members. Main frame members 13 and 23 are positioned along and beneath the adjacent edges 30 and 31 of their respective table surface members.

Leg assemblies 34 and 48 are provided for the two table halves. Leg assembly 34 for the side of the table including table surface member 10 comprises a pair of legs 35 and 36 which are pivotally connected by pivot bolts 37 and 38, to frame arm members 14 and 15 respectively. Legs 35 and 36 are interconnected by a crossbar 39. Feet or glides 44 and 45 are provided at the bottoms of legs 35 and 36 respectively. Offset supports 40 and 41 are provided on legs 35 and 36 respectively near the bottom ends thereof, and caster wheels 42 and 43 are connected respectively to the offsets.

Leg assembly 48 for table surface member 11 is identical to leg assembly 35 and comprises legs 49 and 50 which are secured to frame arms 24 and 25 by pivot bolts 51 and 52. The legs are connected by a crossbar 53, and have feet or glides 58 and 59. Offset supports 54 and 55 and caster wheels 56 and 57 are provided for legs 49 and 50 respectively.

A pair of cross connect links 61 and 71 are provided for controlling the pivoting of the leg assemblies as the table is moved between its storage and usable positions. The pair of ears 62 are provided on crossbar 39 spaced apart to receive the end of cross connect link 61, which is pivotally connected thereto by a pivot bolt or pin 63. The other end of cross connect link 61 is pivotally connected to another pair of ears 64 by a pivot pin 65. Ears 64 are welded to main frame member 23 and project downwardly and backwardly away from adjacent edge 31.

Cross connect link 71 is connected in a manner similar to 61. One end of link 71 is connected by a pivot pin 73 to ears 72 provided on crossbar 53. The other end is connected by pivot pin 75 to ears 74 which are welded to main frame member 13. As seen in FIG. 3, the two cross connect links and their respective ears are offset slightly from center so as to not interfere with each other, and also so that the same frame and leg assembly can be used interchangeably for either table half.

It will be noted that the cross connect links connect from the legs on one side of the table to the frame of the other side of the table. The geometry of the cross connect links including their length and the positioning of their pivot points is selected as is generally known in the prior art in order to provide for folding of the table between the storage position shown in FIG. 1, in which the table surface members are generally vertically oriented against their legs, and the usable position shown in FIG. 2 in which the table surface members are horizontally positioned adjacent one another to form the continuous table surface. In the storage position, the legs are held relatively vertically so that the table is supported on the caster wheels. As the table is moved to its usable position, the legs are tilted slightly off vertical to lift the caster wheels and cause the table to rest on the feet portions of the bottoms of the legs.

Figure 8:
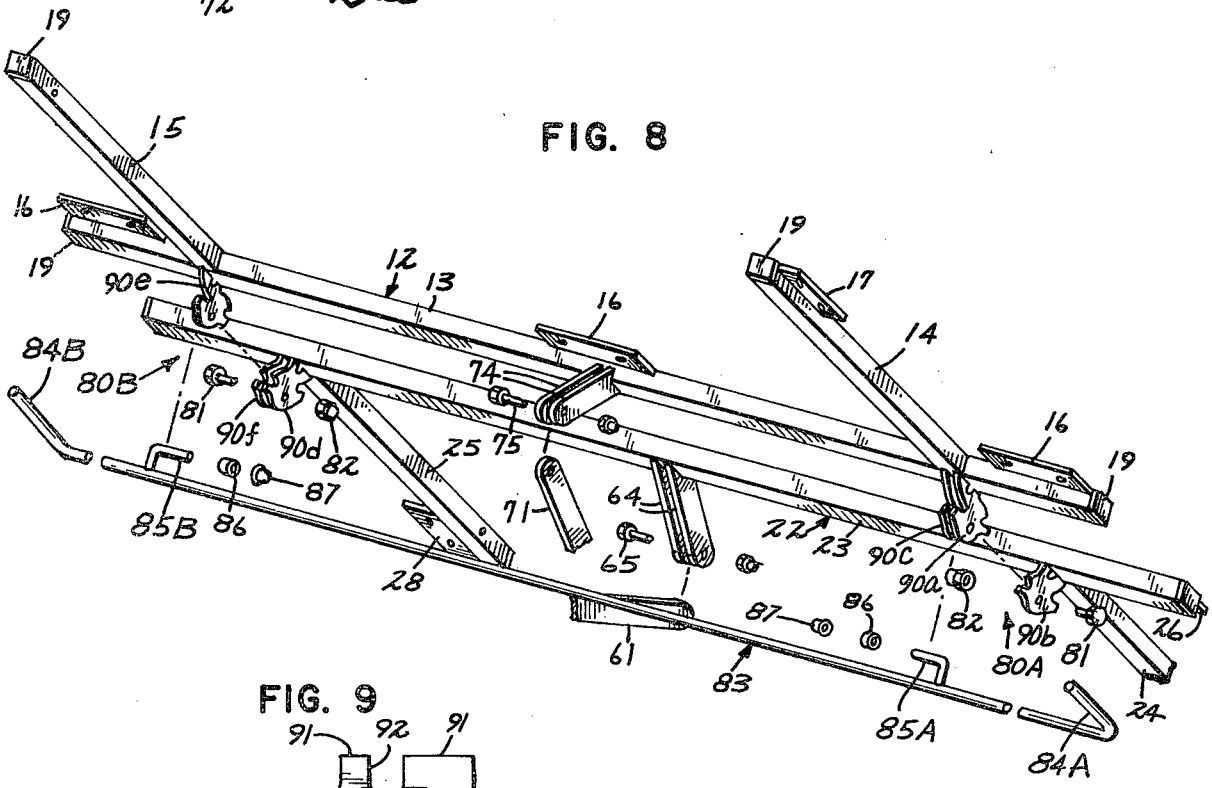
FIG. 8 is a view in exploded perspective of the lockable hinge mechanism according to the present invention.

The construction of the lockable hinge is best seen in FIG. 8, in which the table surface members and legs have been deleted, so as to better show the main frame members 13 and 23 and the hinge means which interconnects them. In the preferred embodiment as shown in the drawings, the hinge assembly includes a pair of hinge assemblies 80A and 80B, which comprise a plurality of hinge plates attached to the frame members and pivotally connected by pivot bolts. Hinge assembly 80A includes hinge plates 90*a* and 90*c* which are welded to the underside of main frame member 13 where it is intersected by frame arm member 14. Hinge plates 90*a* and 90*c* are spaced apart a distance to receive hinge plate 90*b* which is attached to the underside of main frame member 23 at its connection to frame arm member 24. FIG. 8 is an exploded view, and it will be appreciated that when fully assembled, hinge plate 90*b* fits between hinge plates 90*a* and 90*c*, and a pivot bolt 81 passes through apertures provided in all three hinge plates and is secured by a cap nut 82.

Hinge assembly 80B at the other end of the frames is similar, with hinge plates **90*d* and 90*f* attached to the underside of main frame member 23 near the connection thereto of frame arm member 25. Hinge plate 90*e* is provided beneath main frame member 13 at its connection to frame arm member 13. Hinge plate 90*e* fits between plates 90*d* and 90*f*, and pivot bolt 81 passes through apertures provided therein and is secured by cap nut 82**.

It will be appreicated that although the preferred embodiment shown uses a pair of hinge assemblies, the invention is not so limited, and additional hinge assemblies could be provided at the center or at other points along the frame members.

Lock bar 83 is an elongate steel rod or bar extending substantially the width of the table. Bar 83 has handle portions 84A and 84B formed at its ends, and these handles extend perpendicularly to the axis of lock bar 83. A pair of L-shaped pivot pins 85A and 85B are welded to lock bar 83 at either end, spaced inwardly from the handles. These pins have pivot portions parallel to lock bar 83 and offset or foot portions which serve to space the pivot portions a predetermined distance from the lock bar.

Figure 9:
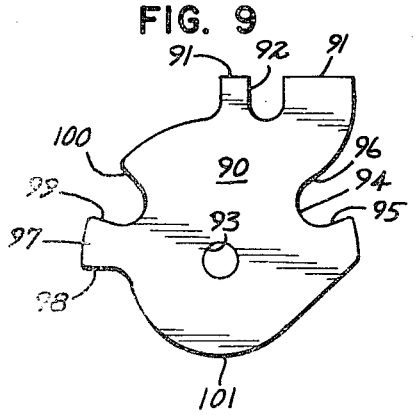
FIG. 9 is an elevational view in enlarged scale of a hinge plate according to a preferred embodiment of the present invention.

The hinge plate according to the preferred embodiment is shown in greater detail in FIG. 9. The hinge plate, which may be made from a steel plate, is generally planar in configuration, with special shapes formed in its edges to cooperate with locking bar 83 to achieve the locking function as explained hereinafter. As seen in FIG. 9, hinge plate 90 includes the aperture 93 which receives pivot bolt 81, by means of which the hinge plates are pivotally connected. Hinge plate 90 has a base edge 91 which is generally flat and which is intended for abutment with the underside of the table main frame members. The hinge plates may be secured in place by welding them to the frames along edge 91.

A pivot recess 92 is provided in base edge 91 for receiving the pivot pin of the locking bar. When base edge 91 of the hinge plate is welded to the base frame, pivot recess 92 and the adjoining portion of the frame member define an aperture for receiving pivot pins of the lock bar. Specifically, recesses 92 of hinge plates **90*a* and 90*c* receive pivot pin 85A and recess 92 of hinge plate 90*e* receives pivot pin 85B. Recesses 92 of hinge plates 90*b*, 90*d* and 90*f*** are not used.

Referring again to FIG. 9, a bar recess 94 is provided along one edge, and is sized to receive the thickness of lock bar 83. Recess 94 extends generally radially inwardly towards aperture 93, and has a first edge 95 and a second edge 96.

On generally the other side of hinge plate 90 there is provided a tab 97, which projects generally radially outwardly from aperture 93. Tab 97 has a first edge 98 and a second edge 99.

In FIG. 9, reference number 101 generally designates the portion of the edge of the hinge plate opposite base edge 91, and between bar recess 94 and tab 97 along the edge of the hinge plate. In the preferred embodiment as shown in FIG. 9, edge portion 101 has a generally arcuate or circular configuration for convenience in manufacture, but it will be appreciated that other shapes could be used, since the shape of edge 101 is not critical, so long as edge 101 does not extend beyond a radius from aperture 93 equal in length to the bottom of recess 94. For example, a portion of the bottom of plate 90 in FIG. 9 could be cut off, so long as edge 98 is defined, and enough material is left to define edge 95 of recess 94.

The edge of hinge plate 90 from the bottom of tab edge 99 can proceed directly to edge 91, or optionally, as shown in FIG. 9, another edge 100 can be provided, for abutment with the lock bar when the table is in its horizontal position. In that case, an additional recess is formed between second edge 99 of tab 97, and abutment edge 100, and this recess is sized to receive the thickness of lock bar 83.

Referring again to FIG. 8, hinge plates **90*a* through 90*f* are positioned on their respective frame members so that tabs 97 project towards the opposite frame members, and so that bar recesses 94** face away from the opposite frame members.

Pivot pins 85A and 85B are spaced apart to correspond with the spacing of hinge assemblies 80A and 80B, and to allow insertion into the pivot recesses 92 by inserting the pivot pin on one side all the way to the foot portion of the pivot pin, then inserting the other pin in its recess and returning the lock bar to a centered position. Sleeves 86 fit over the ends of pivot pins 85A and 85B, and retaining caps 87 secure the ends of the pivot pins to hold the locking bar in place. The sleeves serve to space the retaining cap a distance away from the hinge plates so that the flange on the retaining cap will not interfere with the opposite hinge plates.

Figure 4:
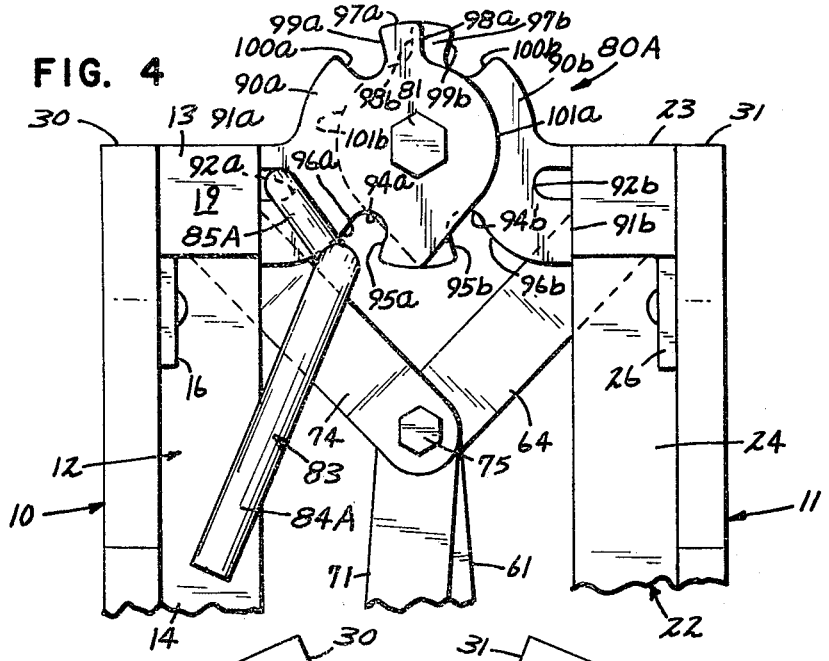
FIGS. 4, 5 and 6 are enlarged fragmentary elevations showing different positions of the lockable hinge according to the present invention.
Figure 5:
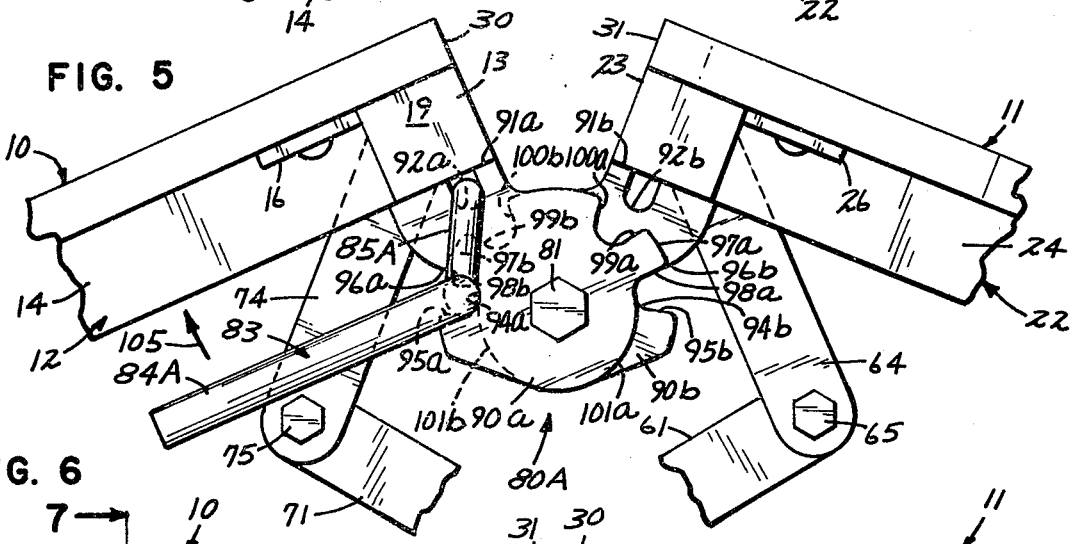
Figure 6:
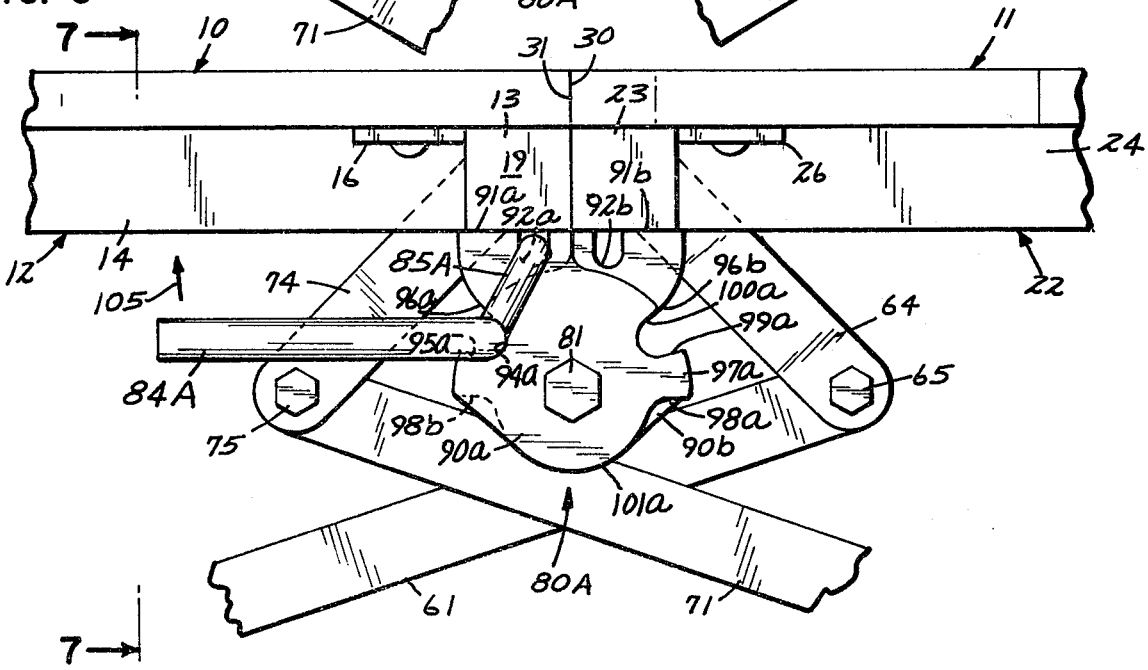
Figure 7:
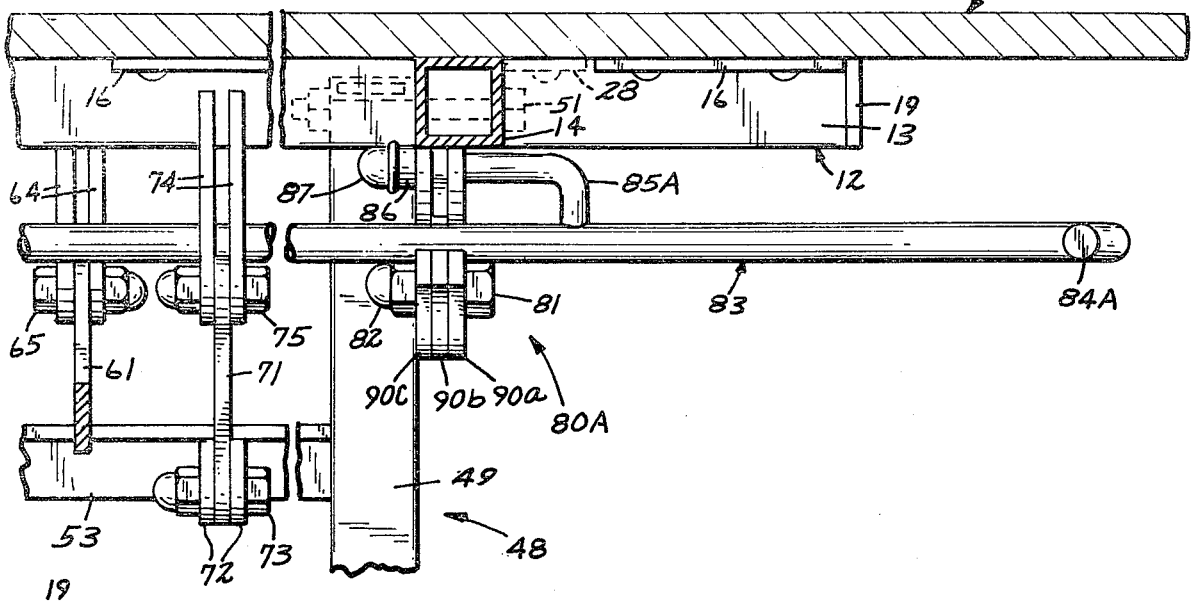
FIG. 7 is a view in vertical section as seen from the line 7—7 of FIG. 6.

As seen in FIGS. 4–6, the lock bar is positioned on the back side of hinge plates **90*a*, 90*c* and 90*e*** so that the lock bar is kept beneath and behind the adjacent edges of the table surface members.

With the aid of FIG. 8 and FIGS. 4–6, the operation of the locking hinge will now be explained. The length of the foot portions of pivot pins 85A and 85B are selected so that the distance between lock bar 83 and the parallel portions of pivot pins 85A and 85B corresponds to the distance between pivot recess 92 and bar recess 94 on hinge plates 90. Thus as seen in FIG. 4, lock bar 83 is capable of an arcuate pivoting motion about the pivot pin, so as to bring the locking bar into and away from bar recess 94 of hinge plates **90*a*, 90*c* and 90*e***.

FIGS. 4, 5 and 6 are seen from one end of the table, and only hinge plates **90*a* and 90*b* are visible. Of course, hinge plate 90*c* is directly behind 90*a*, spaced to receive hinge plate 90*b* between them. Although the individual hinge plates of hinge assembly 80B are not seen in FIGS. 4–6, the operation of that assembly is identical to the side that is shown. In the explanation of FIGS. 4–6 which follows, the various parts of hinge plate 90*a*** are given the suffix letter *a*, and the various parts of hinge plate **90*b*** are given the *b* suffix.

In FIG. 4, the table is in its vertical storage position, with table surface members 10 and 11 generally vertically oriented. Lock bar 83 is pivoted by gravity away from recess **94*a*. As the table is opened, table surface member 10 and hinge plate 90*a* begin to move in a clockwise fashion about pivot bolt 81. At the same time, table surface member 11 and hinge plate 90*b* begin to move in a counterclockwise direction. Again using pivot bolt 81 as the reference point, this means that both the lock bar and recess 94*a* begin to move in a counterclockwise direction. At the same time, lock bar 83 begins to move into recess 94*a*, as better seen in FIG. 5, by the force of gravity. At the intermediate locking position of the table indicated in FIG. 5, the lock bar and recess 94*a* and tab 97*b* have moved to a position to where tab 97*b* is contacting lock bar 83**. Specifically, lock bar 83 is jammed between the first edge 95*a* of bar recess 94*a*, and the first edge 98*b* of tab 97*b*. At this position the table is locked and will not proceed any further towards the full horizontal position until handle 84A (or handle 84B on the other side of the table) is moved upwardly toward table surface member 10 as indicated by arrow 104 in FIG. 5. This causes lock bar 83 to pivot away from bar recess 94*a*, allowing tab 97*b* to pass, and the table proceeds to the horizontal usable position shown in FIG. 6. When the handle is released, the lock bar 83 falls back into recess 94*a*, and into the recess formed between second edge 99*b* of tab 97*b* and the abutment edge 100*b*.

In the usable position adjacent edges 30 and 31 of the table surface member, and/or the main frame members 13 and 14 abut each other to prevent the table from proceeding beyond horizontal. Alternatively, in case the adjacent edges are rounded or cut back, abutment edge 100*b* of hinge plate 90*b* engages lock bar 83 to stop further movement of the hinge. It will thus be seen that abutment edge 100 is not necessary if the adjacent edges of the table surface members abut each other to define the horizontal position of the table.

While the table is in its usable position as shown in FIG. 6, it is locked and prevented from starting to fold. An attempted folding motion causes lock bar 83 to be jammed between second edge 96*a* of recess 94*a*, and second edge 99*b* of tab 97*b*. This prevents the table from accidentally starting to fold in case excessive weight or pressure is applied to the outer ends of the table surface members. To fold the table, it is necessary to move handle 84A or 84B upwardly towards the underside of table surface member 10 as indicated by arrow 105 in FIG. 6. This removes lock bar 83 from recess 94*a* and from interference with tab 97*b*, and allows the table to be refolded.

It will be appreciated from the above description of the operation that the tab portion 97*a* of hinge plate 90*a* is not used. Similarly, bar recess 94*b* and pivot recess 92*b* of hinge plate 90*b* are not used. These parts are provided in the interest of simplicity and economy so that a single hinge plate part can be used for either side of the table.

Another advantage of the preferred embodiment is that the two halves of the table are identical to each other. Specifically, the two leg assemblies 34 and 48 are identical and interchangeable, as are the table surface members 10 and 11, and the frame assemblies 12 and 22. Thus, except for the positioning of the locking bar 83, the two frame assemblies and hinge assemblies shown in FIG. 8 are identical and interchangeable. This greatly simplifies the manufacturing process since it reduces the number of separate parts and assemblies which must be fabricated and stored.

The only thing nonsymmetrical about the assembly of FIG. 8 is the locking bar, since it is installed on only one side of the table. However, it can be installed on either side. For example, in FIG. 8, locking bar 83 could be turned around end for end so that the handles would project the correct way, and the pivot pins 85A and 85B could then be inserted in the pivot recesses 92 of hinge plates 90*f*, 90*d* and 90*b*, and the operation would remain the same.

Of course it is possible to provide separate "left" and "right" hinge plates rather than a single interchangeable design as shown herein. In that case, one of the hinge plates would have a recess corresponding to recess 94 of FIG. 9 and the other hinge plate would have a tab corresponding to tab 97. Other than the fact that the table sides would no longer be interchangeable, such an embodiment would work exactly as described herein above.

It is also possible that only a pair of hinge plates could be used for each of the hinge assemblies, rather than a sandwich of three plates as shown in the preferred embodiment. The use of a pair of plates on one side of the hinge mating with a single plate on the other side as shown in the preferred embodiment is believed to be preferable because it helps balance the forces which are applied to the bar during the locking operation, which adds to the overall rigidity and durability of the hinge.

Thus, the present invention provides a folding table with an improved lockable hinge, to lock the table in the horizontal usable position and also in an intermediate position. The hinge is simple to manufacture and assemble, and is reliable and convenient in operation. The use of a single hinge plate design that can be used on either side of the table further simplifies the manufacturing process. The positioning of the lock bar behind the hinge plates and away from exposure between the adjacent edges of the table halves contributes to safety of operation.

I claim:

1. An improved lockable hinge for a folding table which includes a pair of table surface members, legs pivotally attached to the table surface members and hinge means connecting the table surface members along adjacent edges thereof for permitting folding of the table between a storage position in which the table surface members are generally vertically oriented, and a usable position in which the table surface members are generally horizontally positioned adjacent each other to define a table surface, with the hinge means comprising at least a pair of hinge plates attached respectively to the table surface members beneath their adjacent edges, means pivotally connecting said hinge plates, and a lock bar for selectively engaging the hinge plates to lock the table in intermediate and usable positions, wherein the improvement comprises means for suspending said lock bar beneath one of said table surface members with the lock bar positioned so that the hinge plate is between the lock bar and the adjacent edge of the table surface member and said lock bar is spaced from said adjacent edge and for permitting movement of said bar toward said hinge plate as the table is moved from its storage position, the hinge plate on said one table surface member having a recess formed in its edge for receiving said locking bar, the hinge plate on the other of said table surface members having a tab with a first edge positioned to engage said lock bar when the table reaches said intermediate position short of said usable position and a second edge positioned for engaging the lock bar when the table is in its usable position, said lock bar being spaced from said adjacent edge in all said table positions, and a handle attached to said lock bar extending away from said adjacent edges, whereby said handle can be actuated to remove the lock bar from the hinge plate recess to release the lock.

2. An improved lockable hinge according to claim 1 wherein said hinge means comprises a pair of hinge assemblies, one near each side of the table.

3. An improved lockable hinge according to claim 2 wherein each hinge assembly includes a single hinge plate on one of said table surface members, and a pair of hinge plates on the other table surface member and spaced apart to receive the single hinge plate, and a hinge pin pivotally connecting said hinge plates.

4. An improved lockable hinge according to claim 2 wherein said lock bar comprises a rod extending substantially the width of the table and having end portions extending perpendicular to the center portion of said bar in a direction away from the adjacent edges of the table surface members so as to form handles beneath and along the sides of one of the table surface members.

5. An improved lockable hinge according to claim 4 wherein said means for suspending said lock bar includes pivot pins attached to said lock bar with pivot portions parallel to said bar and spaced apart therefrom.

6. An improved lockable hinge according to claim 5 wherein said hinge plates have recesses formed therein near their points of connection to the undersides of said table surface members, for receiving the pivot pins of said lock bar.

7. An improved lockable hinge according to claim 1 wherein said hinge plates are identical, having said recesses formed in the edge on one side thereof, and said tab formed in the edge on the other side thereof, whereby said hinge plates can be interchangeably used on either table surface member.

8. An improved lockable hinge according to claim 7 wherein said hinge plates have recesses formed near their points of connection to the table surface members, and wherein said lock bar has pivot pins attached thereto for fitting into said recesses for suspending said lock bar therefrom, whereby said lock bar can be installed on either of the table surface members of said table.

* * * * *